United States Patent [19]

Kennedy

[11] 4,246,877

[45] Jan. 27, 1981

[54] NOTCHED INJECTOR HOLD-DOWN CLAMP

[75] Inventor: Lawrence C. Kennedy, Birmingham, Mich.

[73] Assignee: General Motors Corporation, Detroit, Mich.

[21] Appl. No.: 61,191

[22] Filed: Jul. 27, 1979

[51] Int. Cl.[3] ..... F02B 3/00

[52] U.S. Cl. ..... 123/470; 239/533.3

[58] Field of Search ..... 123/32 R, 32 JV, 139 AW; 239/88, 90, 533.1–533.15; 403/260, 261, 262, 353, 375; 248/500, 507, 508, 560, 618, 622, 629; 308/2 A

[56] References Cited

U.S. PATENT DOCUMENTS

| | | | |
|---|---|---|---|
| 1,944,371 | 1/1934 | Ritz | 239/90 |
| 2,096,344 | 10/1937 | Schlaupitz | 123/32 R |
| 2,144,861 | 1/1939 | Truxell, Jr. | 123/32 R |
| 2,316,887 | 4/1943 | Pate et al. | 123/32 R |
| 3,006,556 | 10/1961 | Shade et al. | 239/90 |
| 3,065,003 | 11/1962 | Whitehouse | 403/375 |
| 3,154,372 | 10/1964 | Kolm | 248/560 |
| 3,290,949 | 12/1966 | Samet | 308/2 A |
| 3,787,024 | 1/1974 | Dzus | 248/507 |
| 4,096,998 | 6/1978 | Siwak et al. | 123/32 R |

FOREIGN PATENT DOCUMENTS

| | | | |
|---|---|---|---|
| 230455 | 8/1969 | U.S.S.R. | 248/560 |

*Primary Examiner*—P. S. Lall

*Attorney, Agent, or Firm*—Arthur N. Krein

[57] ABSTRACT

A one piece hold-down clamp for a fuel injector is provided with one or more transverse notches located in the central area of the clamp over the injector contact surface of the clamp to control clamping forces as applied by spaced apart hold down bolts threaded into the cylinder head of an engine.

3 Claims, 9 Drawing Figures

NOTCHED INJECTOR HOLD-DOWN CLAMP

This invention relates to diesel type unit injectors and, in particular, to notched hold-down clamps for such injectors, or similar mechanisms, used to secure such injectors to the cylinder head of an engine.

In many diesel engines, individual injectors, such as unit injectors, are mounted in the cylinder head of the engine in position to supply fuel to the engine combustion chambers.

It is also known in diesel engine construction, where such unit injectors are used to supply fuel to the engine combustion chambers, to cool the injectors as well as the combustion chamber walls by means of liquid coolant circulated through a cooling jacket provided for this purpose in the cylinder head of the engine. In order to separate the body of each unit injector from direct contact by the cooling liquid as well as to prevent leakage of the cooling liquid into the combustion chamber when an injector is removed temporarily from the cylinder head, it is common practice to provide an injector tube or sleeve surrounding the injector. Such an injector tube or sleeve extends through the cooling water jacket and provides a positive seal with portions of the internal walls of the cylinder head defining the cooling water jacket.

It is also known in diesel engine construction to provide fuel supply and drain passages in the cylinder head of the engine whereby fuel can be supplied to the individual injector and excess fuel returned therefrom without the need of external plumbing to and from the injectors.

In view of the above structural arrangements, it is necessary that each such unit injector be rigidly fixed to the cylinder head of an engine with suitable axial force applied to the injector whereby to provide for a sealing abutment of the injector with its associated injector sleeve. Normally such fixing of a unit injector to the cylinder head is by means of one or more threaded fasteners which extend either through a mounting flange formed as an integral part of a unit injector body or through a hold-down clamp associated with the injector.

Such hold-down clamps are usually either in the form of a flat yoke type clamp similar to those shown, for example, in U.S. Pat. Nos. 1,944,371 entitled "Injector" issued Jan. 23, 1934 to Frederick Ritz and 4,096,998 entitled "Fuel Injector" issued June 27, 1978 to Siwak et al., or in the form of a hold-down crab of the type shown, for example, in U.S. Pat. No. 2,144,861 entitled "Fuel Pump Injector" issued Jan. 24, 1939 to Clyde W. Truxell.

A hold-down crab type clamp has normally been preferred over the yoke type clamp for securing a unit injector to the cylinder head of an engine, because the crab type clamp provides for higher vertical dimensional tolerance capability than the yoke type clamp, while still being operable to maintain the required clamping force on the injector without risk of applying excessive clamping force which could damage either the cylinder head or the injector.

If a flat, yoke type clamp is used, such a yoke clamp normally must have sufficient rigidity such that it does not yield at installation loads. Otherwise, much higher bolt clamp loads must be specified in order to satisfy the possibility of reinstalling the injector with a previously used and possibly bent clamp assembly. That is, if the clamp has yielded in previous one, and is then used to secure an injector into a cylinder head injector hole having different cylinder head to injector height mismatch, the clamp must be rebent to accommodate the variation in height of the injector to the cylinder head. As is well known, the surface of the injector body on which a yoke type clamp abuts normally extends a predetermined distance above the adjacent upper surface of the cylinder head in which the injector is mounted whereby the yoke type clamp is operable so as to apply a hold-down clamping force to the injector.

Although a hold-down crab type clamp is normally preferred over a flat yoke type clamp, in certain engine applications it may be desirous to use two such crab type clamps for securing a unit injector to the cylinder head of the engine. However space limitations may prevent the use of two such crab type clamps in a particular engine configuration.

It is therefore a primary object of this invention to provide an improved hold-down clamp for a unit injector, wherein the clamp is of the yoke type and wherein the clamp is provided with one or more transverse notches whereby the clamp is operative so as to simulate the function of a two-piece clamp.

Another object of the invention is to provide an improved yoke type hold-down clamp that is provided with one or more transverse notches in the clamp structure, the notch or notches being operative as hinge elements to allow the clamp to bend at a notch under a relatively low bending force whereby this yoke clamp is operative, in effect, as two hold-down crab clamps.

A still further object of this invention is to provide a one-piece hold-down clamp having the clamping character of a two-piece clamp by providing a transverse notch or notches in the central section of the clamp to locally thin the material thereof, thereby resulting in minimal resistance to bending of the clamp across the injector body.

Still another object of the present invention is to be provided a hold-down clamp of the above type which includes features of construction rendering it easy and inexpensive to manufacture, which is reliable in operation and in other respects suitable for reuse on production engines for securing a unit injector, or similar mechanism, to a support member.

For a better understanding of the invention as well as other objects and further features thereof, reference is had to the following detailed description of the invention to be read in connection with the accompanying drawings, wherein.

Figure 1:
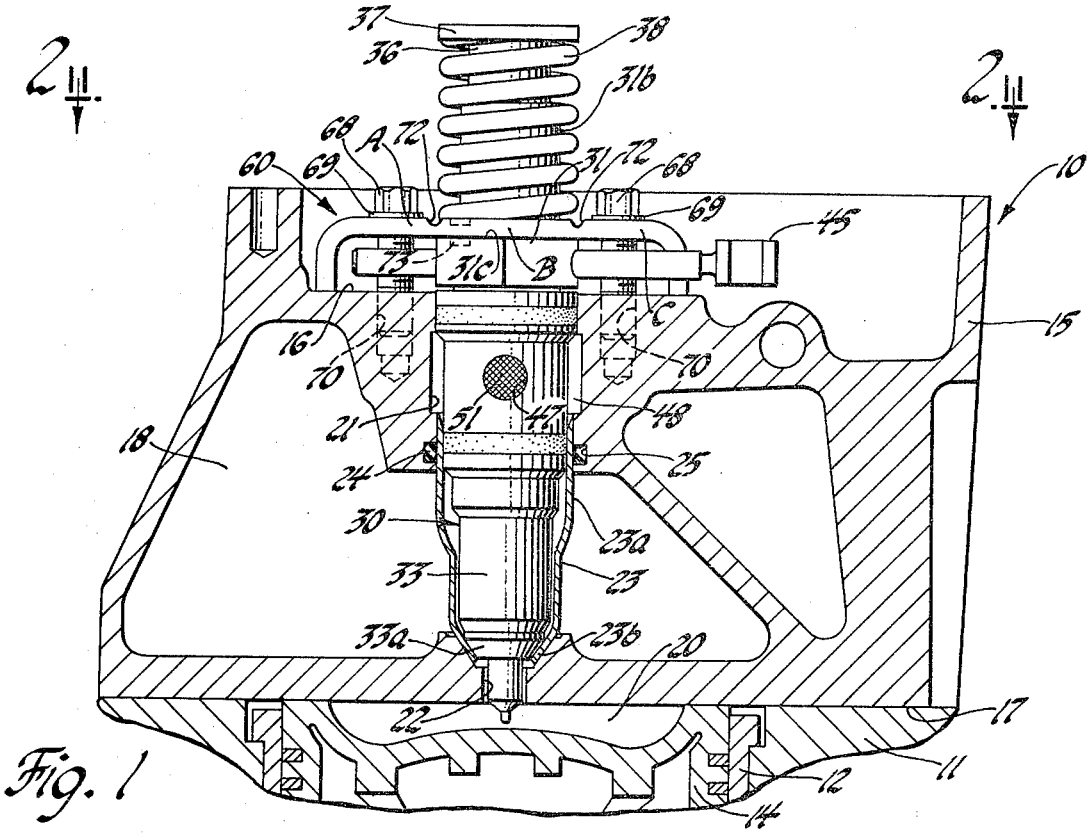
FIG. 1 is a fragmentary cross sectional view of an engine showing a unit injector, in elevation, secured in a cylinder wall by a preferred embodiment of a notched injector hold-down clamp in accordance with the invention, this view being taken substantially along the line 1—1 of FIG. 2.
Figure 2:
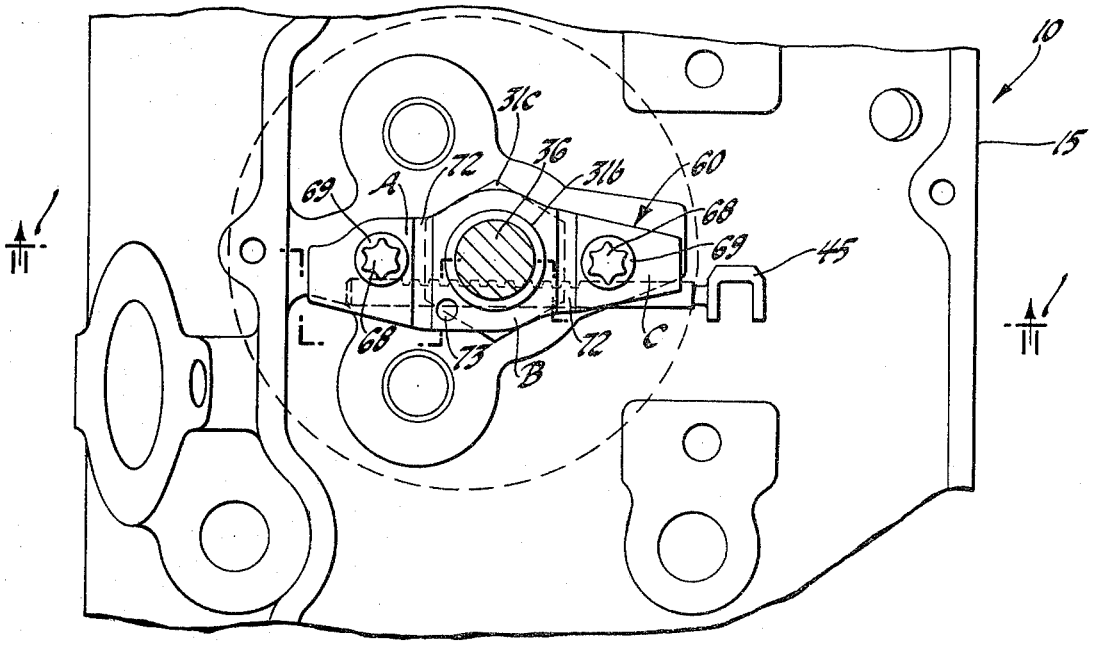
FIG. 2 is a top plan view of a portion of an engine taken along line 2—2 of FIG. 1, but with the return spring removed, to show the details of the notched injector hold-down clamp of FIG. 1 positioned against a support flange of a unit injector body whereby to retain the unit injector in the cylinder head of an engine.
Figure 3:
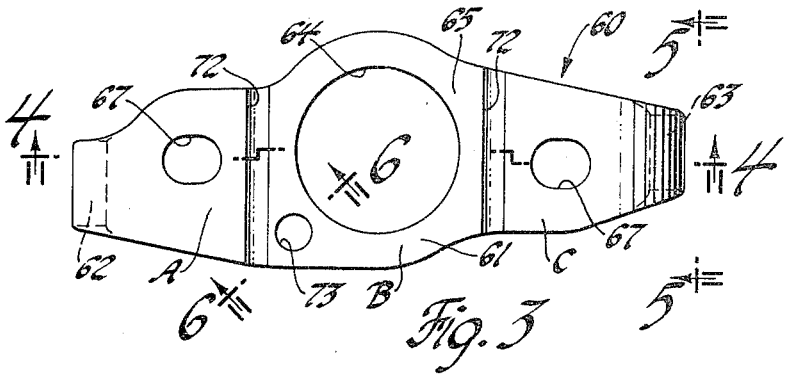
FIG. 3 is a top plan view of the notched injector hold-down clamp per se of FIGS. 1 and 2.
Figure 5:
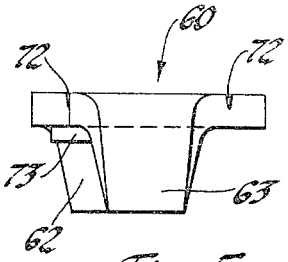
FIG. 5 is an end view of the notched injector hold-down clamp of FIG. 3 taken along lines 5—5 of FIG. 3.

Referring now to FIGS. 1 and 2, and in particular to FIG. 1, there is shown an internal combustion engine 10 of the compression ignition type. Engine 10 has the usual cylinder block 11 carrying a cylinder liner 12 in which a piston 14 is reciprocably disposed. A cylinder head 15 is secured along the upper face of the cylinder block 11 and includes upper and lower walls 16 and 17, respectively, which partly define a cooling water jacket 18. The lower wall 17 of the cylinder head 15 cooperates with the crown of piston 14 to define a combustion chamber 20.

A pair of openings 21 and 22 are provided through the upper and lower cylinder head walls, respectively, with these two openings being coaxially disposed and receiving an injector sleeve or tube 23, made of copper or other suitable heat conducting material. The injector tube 23 includes a cylindrical upper portion **23*a* the outer peripheral surface of which is adapted to engage an O-ring seal 24 carried in a counterbore portion 25 of opening 21 to prevent leakage of coolant from the water jacket 18**.

As seen in FIG. 1, the lower end **23*b* of injector tube 23, which is received in opening 22 is suitably conically tapered so as to conform to the tapered internal wall of the cylinder head defined by the upper portion of opening 22**.

The openings 21 and 22 together with the injector tube 23 provides means for the mounting of an injector, such as unit injector 30, into the cylinder head 15 whereby the unit injector extends through the cylinder head so as to be operative for supplying fuel to the combustion chamber 20.

Figure 7:
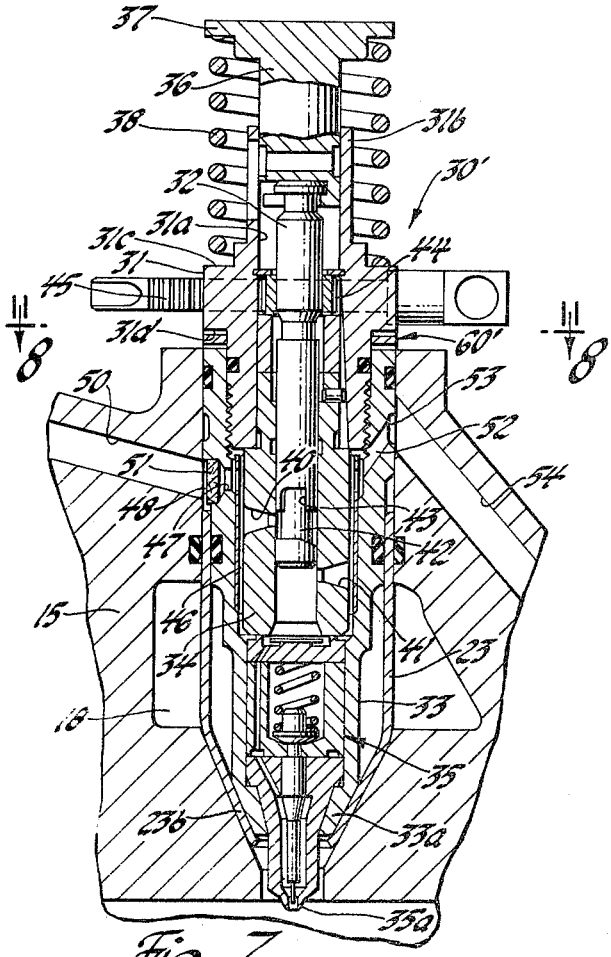
FIG. 7 is a fragmentary cross sectional view of an engine having an alternate embodiment of a notched injector hold-down clamp in accordance with the invention positioned to retain a unit injector in the cylinder head of the engine.

In the construction shown, the unit injector 30 is a conventional unit injector and is similar in construction to the unit injector 30' shown in FIG. 7. As is well known, such a unit injector comprises a housing 31 in which a plunger 32 is reciprocable. Forming an extension of and threaded to the end of the housing 31 is a nut 33 in which is supported the usual side ported bushing 34 forming the pump cylinder for the plunger 32.

Clamped to the lower end of the bushing 34 by the nut 33 is a conventional fuel injector assembly, generally designated 35, having a lower spray tip portion **35*a*. It is not deemed necessary to describe in detail this fuel injector assembly 35** since the details of such an assembly are well known in the art, it forms no part of this invention, and the details thereof are not required for an understanding of the subject invention. However, for details of such a fuel injector assembly, reference is made to U.S. Pat. No. 3,006,556 entitled "Unit Fuel Pump-Injector" issued Oct. 31, 1961, to William S. Shade and Conrad A. Teichert, the disclosure of which is incorporated herein by reference thereto.

The plunger 32 is actuated by a follower 36 slidably fitted in the upwardly open bore **31*a* in the housing 31 coaxially with plunger 32. The upper end of the follower 36 suitably carries an enlargement or head 37 and the follower is operatively positioned above the cylinder head 15 so as to be driven by a suitable operator, not shown, in a conventional manner for effecting movement of the plunger 32 on a pump stroke, downward with reference to FIG. 7. Return of the plunger 32 is effected by means of a follower return spring 38 suitably interposed for this purpose between the head 37 and housing 31**.

In the construction of such a unit injector, as shown for example, in FIG. 7, the bushing 34 is provided with fuel inlet and bypass ports 40 and 41, respectively, which are controlled by the plunger 32. As is conventional, the plunger 32 is provided with a metering groove 42 which has at least one helical control edge 43 which determines timing and the quantity of fuel flow during each plunger stroke, in accordance with the angular position of the plunger 32 about its longitudinal axis. Likewise, conventional means for rotatably adjusting the plunger 32 is also provided, as in the form of a pinion 44 on the plunger meshing with teeth, not shown, on a fuel control rack 45. By longitudinally shifting this rack 45, the plunger 32 is rotated since the pinion 44 is suitably keyed or otherwise slidably secured to the plunger 32.

In the injector 30' construction shown in FIG. 7, the annular space 46 surrounding the bushing 34 within the nut 33 is supplied with fuel, as for example, via at least one side port 47 in the nut 33 in flow communication with an annular supply chamber 48 encircling the injector which is provided with fuel via a fuel supply passage 50 in the cylinder head 15. A filter 51, made of suitable material, is disposed on the upstream side of each side port 47. Excess fuel supplied to the unit injector is returned to the fuel tank, not shown, via an inclined side port 52 in nut 33 that opens into an annular groove 53 which is axially positioned for communication with a fuel return passage 54 provided for this purpose in the cylinder head 15.

In the injector 30 construction shown in FIG. 1, the nut 33 thereof is provided with at least two side ports 47, only one of which is shown, with these side ports being equally spaced circumferentially about the nut for flow communication with the associated annular supply chamber 48. Each side port 47 is provided with an associated filter 51. All of the in-line unit injectors in the cylinder head 15 are supplied with fuel by means of a single fuel supply passage, not shown, which interconnects with each of the annular supply chambers 48 surrounding the respective unit injectors 30, only one being shown. Excess fuel pumped through the fuel supply passage 50 passes through and around the nut 33 of the respective unit injectors, cooling the injectors as well as providing a fuel supply source thereto. Excess fuel is returned to the fuel tank, not shown, for the engine in a conventional manner, but through this single fuel supply passage.

As shown in FIGS. 1 and 7, a unit injector is installed in an associated cylinder head so that the tapered end portion **33*a* at the bottom of the associated injector nut 33 bears against the internal wall of the lower conical seat portion 23*b* of the associated injector tube 23 so as to form a seal joint therewith. This seal joint, which is a metal to metal seal, is made by forcibly clamping the nut 33 of the unit injector against the seat portion 23***b* by a clamp secured to the cylinder head by one or more threaded fasteners threaded into the cylinder head. As is well known, the clamp should be such so as to provide a clamping force which creates a positive seal between the tapered end of the injector nut and the annular seat of the injector tube whereby to force this portion of the injector tube downwardly so as to exert pressure on the abutting surfaces of the injector tube and the adjacent wall of the cylinder head whereby to also positively seal this joint.

Now with reference to FIGS. 1 and 2, this clamping force on a unit injector 30 is applied by means of a hold-down clamp 60 constructed in accordance with a preferred embodiment of the invention. The clamp 60, in the preferred embodiment shown in FIGS. 1 through 6, is made, for example, of suitable spring steel material and is in the form of a yoke type clamp. In the construction shown, the hold-down clamp 60 is of inverted U-shaped configuration whereby it can be incorporated into unit assembly with the unit injector 30 so that it is also operative to serve as the lower abutment member for the plunger return spring 38. This unit assembly of the clamp 60 with the unit injector 30 as shown in FIGS. 1 and 2 was made in the configuration shown due to restricted space limitations in a particular engine application.

Figure 4:
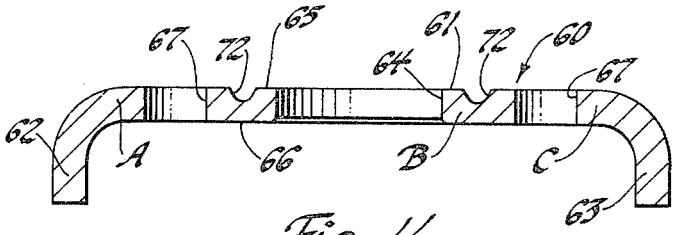
FIG. 4 is a cross sectional view of the notched injector hold-down clamp per se of FIG. 3 taken along line 4—4 of FIG. 3.

As best shown in FIGS. 1 and 4, the hold-down clamp 60 includes a clamp base 61 having integral legs 62 and 63 of predetermined length depending from opposite ends thereof. The base 61 is substantially flat in the as formed configuration, and is of suitable length and width as desired for a particular application and, in the construction shown, the base 61 is of non-uniform width, because of space limitations. Base 61 is provided with a central bore opening 64 that extends from the upper surface 65 of the base to the lower surface 66 thereof. This bore opening 64 is of suitable predetermined internal diameter whereby the base 61 can embrace or encircle a suitable predetermined portion of an associated injector so that portions of the lower surface 66 thereof adjacent to the opening 64 which define a relatively narrow waist portion can abut against a suitable flat abutment surface provided for this purpose on the surface of the injector. Thus as shown in FIGS. 1 and 2 the opening 64 in the base of the clamp 60 is of a suitable diameter so as to loosely receive the upper cylindrical portion 31*b* of the injector housing 31 whereby the lower surface 66 of the base 61 can abut against the flat, upper flange surface 31*c* of injector housing 31 that extends radially outward of its cylindrical portion 31*b*.

Base 61 is also provided with a pair of suitable apertures 67 one on each side of the bore opening 64 and uniformly spaced therefrom so as to receive threaded fasteners such as bolts 68 (FIGS. 1 and 2) threadedly received in internally threaded apertures 70 provided for this purpose in the cylinder head 15. Suitable washers 69 are positioned between the heads of the bolts 68 and the upper surface 65 of the clamp.

In accordance with the subject invention, base 61 is also provided with a pair of transverse grooves or notches 72 formed parallel to each other on opposite sides of the bore opening 64, as best seen in FIGS. 1 and 2. The transverse notches 72, in the construction shown, are formed in the upper surface 65 and are located on the base 61 of the clamp 60 so as to be positioned closely adjacent to the associated outer periphery of the unit injector adjacent to the flange surface 31*c* whereby to assure a central flat seat for the plunger return spring 38 on the base 61.

The transverse notches 72 are of a predetermined depth relative to the thickness of the base 61 whereby to selectively locally weaken the base 61 at the center of each of these notches. Thus in effect, each of the transverse notches 72 is operative to weaken the base 61 whereby the base can bend and fold along a fold or hinge line corresponding to the center of a notch 72. Thus during clamp down of the hold-down clamp by torque down of the bolts 68, an axial downward load will be applied to the unit injector, and, depending upon the predetermined range of mismatch between the effective height of the unit injector 30, that is flange surface 31*c*, and the top surface of the cylinder head 15, taking into consideration the predetermined height of the legs 62 and 63, the opposite ends of the base 61 outboard of the transverse notches 72 can bend downward, if necessary, to obtain the predetermined required clamping force on the unit injector 30.

By way of example, the hold-down clamp 60 as used in a particular engine application was made of 4.2 to 4.4 millimeter thick spring steel stock. The transverse notches 72, which were made of substantially V-shaped with an included angle of 55° to 65°, and with a rounded bottom, were of a depth so as to provide for a thickness of the remaining material of the base 61 at each notch on the order of 2.5 millimeters thick. In this particular application, the legs 62 and 63 extended approximately 11.1 to 11.4 millimeters below the lower surface 66 of the base.

In the clamp arrangement thus far described, the notches 72 in base 61 divide the clamp 60, in effect, into left, center and right hinge portions A, B and C, respectively, with reference to FIGS. 1, 2, 3 and 4. Each of these hinge portions is integrally hinged to the next adjacent hinge portion along their associated notch or hinge line 72. With this structural arrangement, when a clamp down load is applied by torque of the fasteners 68, the left and right hinge portions A and C, respectively, can bend at relatively low bending moment relative to the center hinge portion B. The center hinge portion B will remain flat since it abuts against a flat injector contact surface, such as the flange surface 31*c* of the injector housing 31. Thus in operation this single piece hold-down clamp 60 simulates the function of two separate clamps.

Preferably, the hold-down clamp 60 is also provided with suitable means to effect proper rotative alignment or indexing of the unit injector 30 in the cylinder head 15, with this rotative indexing being appropriately located relative to the center lines of the apertures 70 in the cylinder head. For this purpose in the construction shown relative to the preferred embodiment of the hold-down clamp 60, the base 61 thereof is provided with an alignment pin 73 that is formed so as to depend downward from the lower surface 66 at a predetermined location. This alignment pin 73 is adapted to be slidably received in a suitable alignment aperture, not shown, provided for this purpose in the flange surface 31*c* of the injector housing 31, in the construction illustrated.

Figure 6:
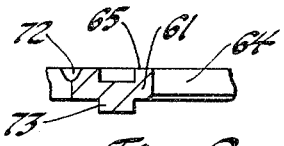
FIG. 6 is a cross sectional view of a portion of the notched injector hold-down clamp of FIG. 3 taken along line 6—6 of FIG. 3 to show the locating pin of the hold-down clamp.
Figure 8:
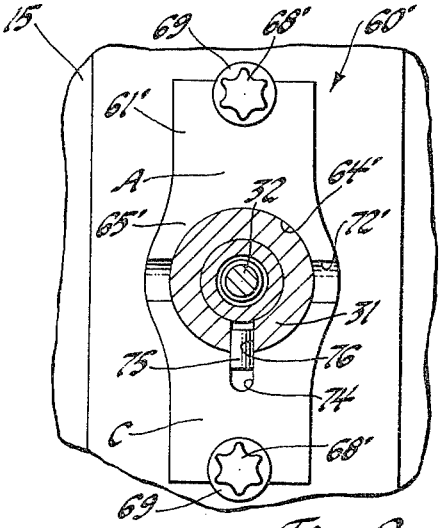
FIG. 8 is a fragmentary top view of a portion of an engine taken along line 8—8 of FIG. 7 to show details of the alternate embodiment hold-down clamp; and, FIG. 9 is a perspective view of the alternate embodiment hold-down clamp, per se, of FIGS. 7 and 8.

An alternate embodiment of a hold-down clamp, generally designated 60', in accordance with the invention is shown in FIGS. 6, 7 and 8, wherein similar parts are designated by similar numerals, but with the addition of a prime (') where appropriate.

In this alternate embodiment, the hold-down clamp 60' includes a base 61' of suitable configuration and of predetermined length and width as desired for a particular application. Base 61' is provided with a central bore opening 64' of suitable predetermined internal diameter.

In the particular application of this holddown clamp 61' shown in FIGS. 7 and 8, the clamp 61 is adapted to be assembled in unit assembly with a unit injector 30'. For this purpose, the hold-down clamp 60' and the bore opening 64' have been appropriately sized whereby the central waist portion of its base 61' loosely encircles the cylindrical depending portion of the injector housing 31 in position so as to abut against the top surface of the nut 33 of this unit injector. As shown in FIG. 7, the lower radial flange surface **31*d* of the injector housing 31 is accordingly arranged so as to be spaced a predetermined axial distance from the upper surface of the nut 33 whereby the base 61'** can be loosely received therebetween.

Base 61' is also provided with suitable apertures 67', in the form of slots, at opposite ends thereof to receive threaded fasteners, such as bolts 68' used to effect clamp down of the unit injector in a cylinder head 15.

In this alternate embodiment, the base 61' is provided with at least one centrally located transverse notch 72' of suitable depth relative to the thickness of base 61' whereby to weaken the base 61' so that opposite ends thereof can bend or fold along a hinge line corresponding to the center of the notch 72'. However, in the particular construction shown, two such transverse notches 72' are used, one being formed in the upper surface 65' of the base 61' and the other being provided in the lower surface 66' of the base 61' along the central area of the clamp 60' over the injector contact surface of the clamp.

In this alternate clamp arrangement the notch or notches 72' divide the clamp 60' into two hinge portions A and C that are integrally hinged together along the common hinge line defined by the notch or notches 72'. With this arrangement, when a clamp load is applied by torque down of the fastener 68', the hinge portions A and C will bend at a relative low bending moment relative to each other whereby this single piece hold-down clamp 60' operates in a manner similar to two separate crab type clamps.

Thus, even though the hold-down clamp 60' has the general appearance of a yoke type clamp, in operation it would be comparable to using two separate crab type clamps to hold down an injector.

Figure 9:
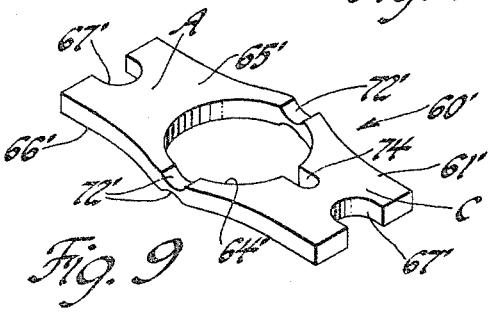

Base 61' is also provided with means for orientating an injector. In the construction shown, the base 61' is provided with a slot 74 that intersects the central bore opening 64'. The center of slot 74 is aligned with the center of the apertures 67' in the base 61', as best seen in FIGS. 8 and 9. This slot 74 is adapted to slidably receive an alignment pin 75 positioned in a suitable radial aperture 76 provided in the injector housing 31, as shown in FIG. 8.

Thus in both embodiments, the subject hold-down clamp is operative to provide a convenient means for correctly orientating an associated injector, utilizing the associated bolts to align the clamp with respect to the cylinder head and utilizing alignment pin means to effect proper orientation of the injector relative to the associated clamp.

By providing a hold-down clamp with one or more transverse notches thereon whereby the clamp operates similar to a two piece clamp, the thickness of this type clamp can be made considerably less than that required for a conventional yoke type hold-down clamp. For example, in a particular application and using the same material in the construction of the clamps, a clamp similar to that shown in FIGS. 7–9, was made of 3.80 to 3.85 millimeters thick stock material, whereas a corresponding conventional yoke type clamp, without the notches therein, required that it be made of 5.0 to 5.5 millimeters thick stock material, whereby both clamps were operative to apply the same clamping force on a unit injector.

The embodiments of the invention in which an exclusive property or privilege is claimed are defined as follows:

1. A hold-down clamp for securing a fuel injector in the cylinder head of an engine, said clamp including a base, which is flat in its as formed configuration, said base having opposed first and second surfaces on opposite sides thereof with a pair of longitudinally spaced apart bolt receiving apertures extending therethrough, said base having a through central aperture located substantially equidistance between said bolt receiving apertures, said central aperture being of a size so as to slidably receive a portion of the injector therethrough whereby portions of said second surface next adjacent to the said central aperture defines a waist portion adapted to embrace and abut against the injector, and at least one groove in said base located intermediate said bolt receiving apertures, the at least one said groove being operative to provide in said base a plastic flow hinge function thereat whereby the portions of said base on opposite sides of the said groove can bend relative to each other under a relatively low bending moment.

2. A hold-down clamp for securing a fuel injector in the cylinder head of an engine, said hold-down clamp being of inverted U-shape and including spaced apart legs with an interconnecting base therebetween, said base having opposed first and second surfaces on opposite sides thereof with said legs extending from said second surface whereby the free ends of said legs are adapted to abut against the cylinder head with said base spaced therefrom, said base having a pair of longitudinal spaced apart bolt receiving apertures extending therethrough and a through central aperture located midway between said bolt receiving apertures, said central aperture being of an internal diameter whereby to slidably receive a portion of the injector therethrough so that portions of said second surface next adjacent to said central aperture define a waist portion adapted to embrace and abut against the injector, and a pair of grooves in said first surface of said base, each of said grooves being located intermediate one of said bolt receiving apertures and said central aperture outboard of the adjacent waist portion, each of said grooves being operative to provide in said base a plastic flow hinge thereat whereby opposite ends of said base can bend relative to said waist portion under a relatively low bending moment so that said hold-down clamp functionally operates as two independent hold-down clamps.

3. A hold-down clamp for securing a fuel injector in the cylinder head of an engine, said clamp including a base, which is flat in its as formed configuration, said base having opposed first and second surfaces on opposite sides thereof with a pair of longitudinally spaced apart bolt receiving apertures extending therethrough, said base having a through central aperture located substantially equidistance between said bolt receiving apertures, said central aperture being of a size so as to slidably receive a portion of the injector therethrough whereby portions of said second surface next adjacent to the said central aperture defines a waist portion adapted to embrace and abut against the injector, and a groove in said base located substantially in line with the axis of said central aperture, said groove being operative to provide in said base a plastic flow hinge function thereat whereby the portions of said base on opposite sides of the said groove can bend relative to each other under a relatively low bending moment so that said clamp functions in a manner similar to two hold-down crabs.

* * * * *